United States Patent [19]

Lloyd

[11] 3,937,177

[45] Feb. 10, 1976

[54] ELECTROSTATIC PRINTING MACHINE WITH IMPROVED TONER FOUNTAIN AND RECOVERY SYSTEM

[75] Inventor: William A. Lloyd, San Jose, Calif.

[73] Assignee: Versatec, Inc., Cupertino, Calif.

[22] Filed: Mar. 7, 1974

[21] Appl. No.: 449,057

[52] U.S. Cl. ..... 118/50; 118/429; 118/DIG. 23

[51] Int. Cl.[2] ..... C23C 13/08

[58] Field of Search ..... 118/50, 56, 326, 419, 429, 118/DIG. 23; 117/37 LE

[56] References Cited

UNITED STATES PATENTS

| | | | |
|---|---|---|---|
| 3,413,143 | 11/1968 | Cameron et al. | 118/DIG. 23 |
| 3,470,848 | 10/1969 | Dreher | 118/429 |
| 3,690,917 | 9/1972 | Hershoff et al. | 118/50 |

*Primary Examiner*—Mervin Stein
*Assistant Examiner*—Steven Hawkins
*Attorney, Agent, or Firm*—Flehr, Hohbach, Test, Albritton & Herbert

[57] ABSTRACT

An improved toner fountain and recovery system for an electrostatic printing machine includes a fountain and supply arrangement for applying fluid toner material to a surface of a web of print material passing across the fountain and a vacuum-operated recovery head disposed to extend transversely of the path of movement of the web and in a manner whereby the recovery head removes toner from the surface of the web. A column of toner fluid forms a fluid head in fluid communication with a flow passage coupled to the recovery head in a manner permitting the height of the hydraulic head to establish the degree of vacuum applied to the recovery head. A valve operable between open and closed positions retains the head of toner responsive to arrested movement of the web so as to close the valve and retain the head of toner while the web is at rest.

13 Claims, 6 Drawing Figures

FIG_1
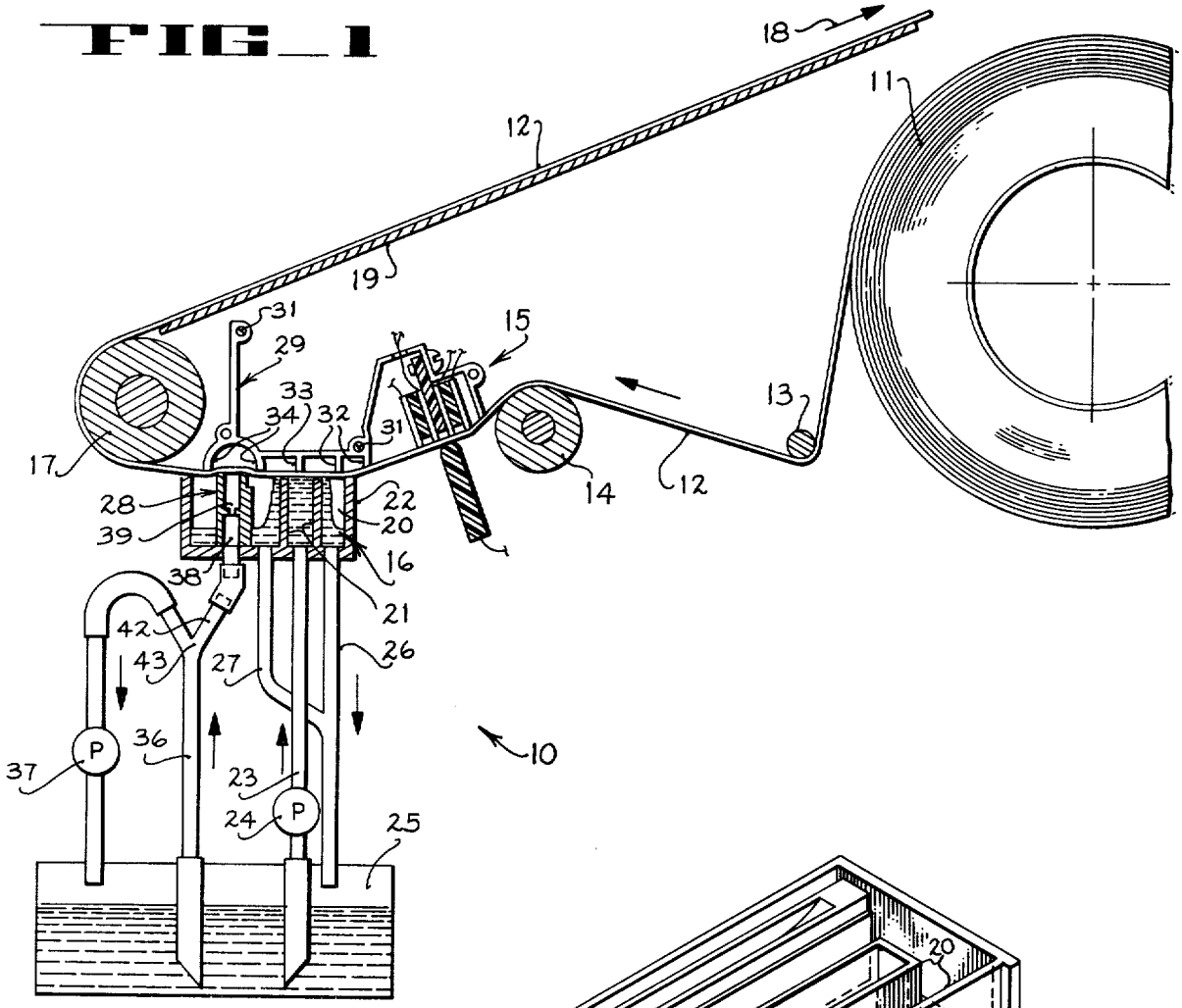
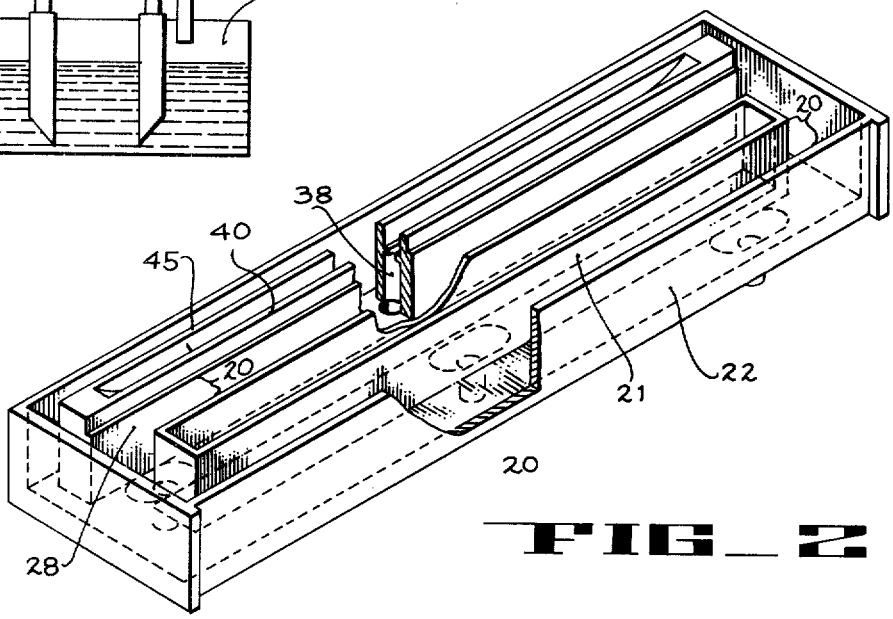
FIG_2

FIG_4
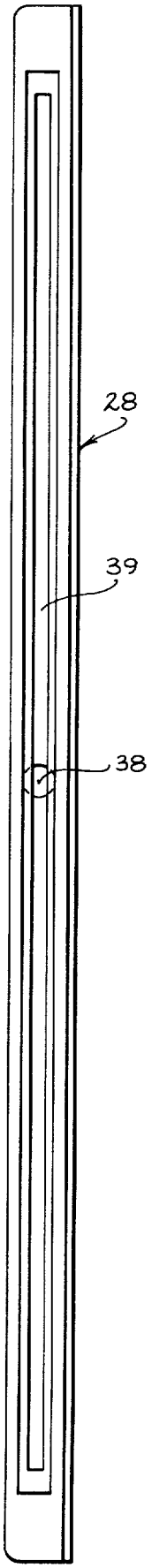
FIG_3
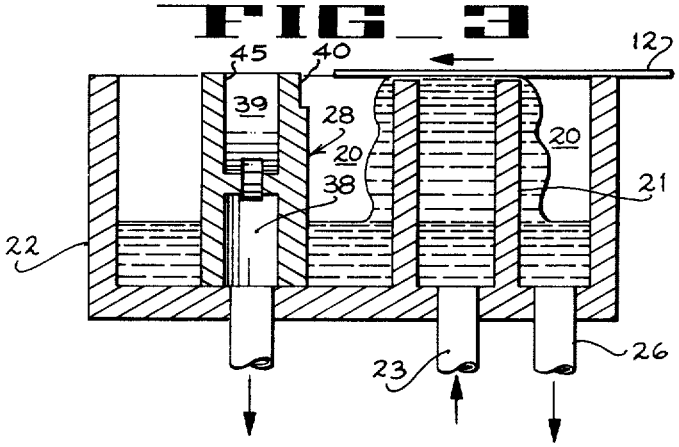
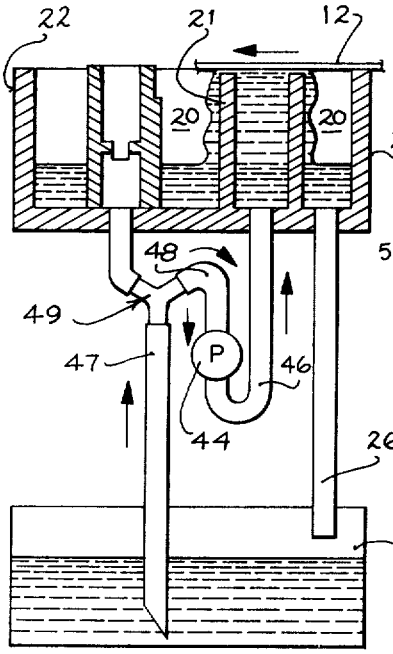
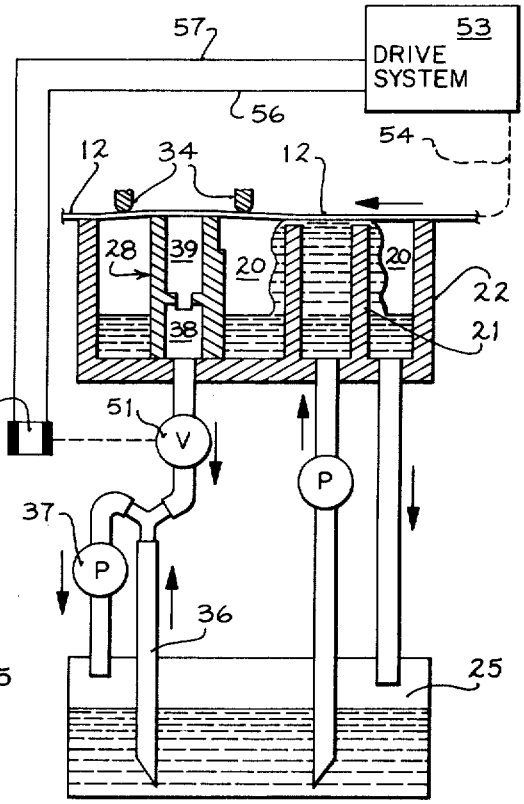
FIG_5 FIG_6

ELECTROSTATIC PRINTING MACHINE WITH IMPROVED TONER FOUNTAIN AND RECOVERY SYSTEM

BACKGROUND OF THE INVENTION

This invention pertains to electrostatic printing machines and more particularly to an improved toner fountain and recovery system for same.

In general, in electrostatic printing machines, an elongate web of material is moved in a predetermined path where, at one station, portions of the surface of the web will be electrostatically charged and thereafter developed in response to application of toner material thereto. Accordingly, the web typically is passed in close proximity across the top of a toner fountain in which liquid toner is overflowing the side edges thereof into a catch basin and returned to a reservoir.

One example of such a toner fountain is shown in U.S. Pat. No. 3,729,123, issued Apr. 24, 1973.

In apparatus of the kind described, the printing web is wetted as it is drawn across the toner fountain. Means are provided for physically removing first the bulk or main portion of the liquid toner and then the remainder.

As disclosed herein, however, vacuum means operating with a degree of suction determined by the hydraulic head required to pump liquid into the toner fountain has been utilized to recover the remainder portion of the liquid toner and to direct it to a toner reservoir.

SUMMARY OF THE INVENTION AND OBJECTS

In general, in apparatus of the kind described above, an improved recovery system includes an elongate, hollow, open top channel member formed to include upwardly extending side walls. The upper end edges of the side walls are disposed to extend acorss the path of the web for engaging the undersurface of the web for physically removing liquid toner therefrom. The open top channel member includes a drain opening coupled to a fluid path serving to return the withdrawn toner material to the reservoir.

In a particularly preferred embodiment, a vacuum connection is formed to provide a suction coupled to the drain opening. The suction serves to draw the web into engagement with the upper end edges of the channel member whereby the surface of the web is subjected to a vacuum to aid in removal of toner material carried by the web and to return it to the reservoir.

In general, it is an object of the present invention to provide an improved toner fountain and recovery system for an electrostatic printer.

It is another object of the present invention to use a liquid pump employed to supply toner to the toner fountain to also form a vacuum in a recovery head member and to provide fluid paths for recovering the toner from both the fountain overflow and the recovery head leading into a common reservoir.

It is another object of the present invention to provide apparatus of the kind described wherein the suction at the recovery member is determined by the liquid column height established in an associated hydraulic pumping column used to supply toner to the fountain.

The foregoing and other objects will be more readily evident from the following detailed descriptions of preferred embodiments when considered in conjunction with the drawings.

BRIEF DESCRIPTION OF THE DRAWINGS

FIG. 1 shows a diagrammatic side elevation view of a system, partially in section, according to the invention;

FIG. 2 shows a diagrammatic enlarged detail perspective view of a toner fountain tray and toner recovery head according to the invention;

FIG. 3 shows an enlarged end section view in detail of the toner fountain assembly;

FIG. 4 shows a plan view of the toner recovery head;

FIG. 5 shows an end elevation section view in diagrammatic form of another embodiment of the invention when used with portions of the construction shown in FIG. 1;

FIG. 6 shows another embodiment of the invention.

DETAILED DESCRIPTION OF PREFERRED EMBODIMENTS

An improved toner fountain assembly and recovery system 10 is shown diagrammatically in FIG. 1. Accordingly, a roll 11 of electrostatic recording material forming a web 12 is suitably trained by means of guides 13, 14 to pass through a recording station 15 wherein discrete dots or pinpoint areas across the width of web 12 can be selectively electrostatically charged. These portions are then developed further downstream in the toner fountain and recovery assembly 16 as to be described further below. Subsequently, as web 12 passes out of assembly 16, it is trained about a roller 17 and moved upwardly in the direction of arrow 18 while supported from beneath by a platen 19.

Toner fountain and recovery assembly 16 generally includes a first elongate tray 21 or trough mounted within a tray 22 serving as a catch basin for the overflowing toner from tray 21.

Means for supplying toner from a reservoir 25 thereof into tray 21 to overflow into tray 22 and permit the overflowed toner to drain back into reservoir 25 comprises the upwardly extending toner supply column 23 in which a pump 24 serves to suck toner upwardly from reservoir 25 for discharge into tray 21.

The crest of the overflowing toner is disposed at a level whereby it will contact the undersurface of web 12. Drainage from catch basin 22 is provided by suitable return lines fed from both sides of the channel 20 formed around tray 21 and schematically shown simply as return lines 26, 27 which lead directly back to the reservoir 25.

Means for holding web 12 closely adjacent to the overflowing top of tray 21 as well as to the top of recovery head 28 includes a pressure member 29 suitably carried by a portion of the frame assembly, such as the screws 31 or rivets. Pressure member 29 may be extruded or molded as desired and extends transversely of the path of web 12. Pressure member 29 includes a number of downwardly depending ribs 32, 33, 34 serving, in conjunction with the top of the fountain and recovery head 28, to define the path for web 12. Accordingly, the lower edges of ribs 32, 33, 34 confine the travel of web 12 so that it passes in close proximity to the top of fountain tray 21 to ride lightly across recovery head 28.

The upper end edges 40, 45 of head 28 are each formed to provide a relatively sharp scraping edge extending transversely of the path of web 12. In this position, edge 40 serves to physically remove the bulk or main portion of the unadhered liquid toner previously applied to web 12 at fountain 21, then, as web 12 engages edge 45, the remainder of the unadhered toner can be physically removed aided by the influence of a vacuum in recovery head 28 as now to be described.

Means forming a second hydraulic column includes the hydraulic riser line or column 36 which takes suction in reservoir 25. Pump 37 lifts toner material from reservoir 25 upwardly into column 36. A drain opening 38 formed to lead into a central cavity 39 of recovery head member 28 is coupled into the top of hydraulic riser line 36 by one leg 42 of a Y connection 43.

The upper end edges 40, 45 of the transverse walls of head 28 lie substantially in a common plane whereby when web 12 passes across them, the suction formed in cavity 39 will serve to draw web 12 tightly in substantially sealed relation thereto. After web 12 forms the seal across cavity 39, pump 37 can lift liquid toner from reservoir 25 upwardly in column 36. The degree of vacuum or suction generated in cavity 39 is determined by the height of the hydraulic column 36.

The foregoing arrangement makes it relatively easy to adjust and accurately provide the proper amount of vacuum to cavity 39 for optimum "drying" of web 12 as it passes head 28.

The embodiment shown in FIG. 1 is particularly desirable where paper is employed of a type having many perforations for reasons which will be described further below.

Another embodiment as shown in FIG. 5 of the toner recovery system wherein a single pump is common to both the toner supply column and the hydraulic vacuum column includes the same trays 21, 22 as shown in FIG. 1 as well as the same toner recovery head 28. However, a single pump 44 is common to both the toner supply column 46 and the hydraulic vacuum column 47.

Column 47 originates with the intake end thereof located within reservoir 25. Pump 44 lifts liquid toner from reservoir 25 along column 47. Web 12 lies in substantially sealed relation against the upper edges 40, 45 of head 29 so as to provide a vacuum in cavity 39 as before described.

Subsequently, toner will rise and spill over into inlet tube 48 after passing Y connection 49 whereby toner from cavity 39 is added to the supply column 46 for entry into tray 21. The overflow from tray 21 returns via downspout 26 to reservoir 25.

In comparing the embodiments shown in FIGS. 1 and 5, it should be relatively evident that, if web 12 is of a type having a number of perforations, the inlet side 48 of pump 44 will tend to suck a substantial amount of air and thereby generate a number of objectionable bubbles into the outlet side 46 for feeding into toner fountain tray 21. Accordingly, where this type of web is employed, the embodiment shown in FIG. 1 may be more desirable inasmuch as the two hydraulic columns are independent of each other thereby permitting toner to be supplied to tray 21 substantially free of bubbles.

However, for most webs 12, there will be sufficient sealing of cavity 39 to preclude entry of objectionable bubbles in a system as in FIG. 5.

Yet another embodiment is shown in FIG. 6 in which a valve 51 is operable by means of a solenoid 52 or other electric control for purposes of operating valve 51 between open and closed conditions.

Pumps 37, 55 are self-priming pumps, such as oscillating pumps. These pumps are slow in pumping air and, accordingly, it is to be appreciated that in each of the foregoing arrangements, if the hydraulic head is lost in column 36 or 47 during intermittent periods of inactive operation, the hydraulic liquid in column 36 will have receded downwardly into reservoir 25 whereby, upon start-up, it then becomes necessary for pump 37 (or 44) to pump out the air on its inlet side to re-establish a sufficient hydraulic head to provide adequate and operable suction within cavity 39.

Accordingly, it is to be understood that means are provided to retain the hydraulic head in column 36 in response to terminating advance of web 12 whereby delay in establishing the head will be avoided. Thus, web 12 is driven by a suitable drive system 53 as indicated by the dashed line connection 54. A circuit 56, 57 from drive system 53 is deenergized at that point in time when drive system 53 has stopped and is energized when it has started.

Thus, upon de-energizing the circuit defined by leads 56, 57 and solenoid 52, valve 51 will be spring urged to a closed position by the spring (not shown) typically associated with a conventional solenoid.

Energizing solenoid 52 can be delayed by suitable delay means forming a part of drive system 53 so as to permit pump 37 to fully establish the hydraulic head in column 36 before exposing cavity 39 to the head in column 36.

From the foregoing, it will be readily evident that apparatus of the kind described avoids the need for the usual separate air pumps or blowers to remove the remaining toner at the discharge side of the toner fountain, i.e., to "dry" the web as is presently the practice. Further, it has been found that high speed web-feeding machines not using suction can feed approximately the equivalent of 10,000 sheets of paper for each 2 gallon bottle of toner. However, by incorporating the suction arrangement for recovering the remainder of the applied toner, approximately the equivalent of 30,000 sheets of paper can be fed using the same two gallon bottle of toner, thereby effecting a significant recovery economy while also drying the web.

It is further readily evident that a liquid pump can be employed to remove both air and liquid from the recovery head so as to recover and return toner to the same common reservoir as supplies the web without deleterious effect upon the quality of the toner being fed from the toner fountain.

Finally, optimum vacuum or suction in cavity 39 of head 29 can be readily achieved since it is directly determined by the liquid column height or pressure head of that column coupled to the recovery head 28.

I claim:

1. In a printing machine of a type having an elongate web of material to be moved in a predetermined path for printing thereon by charging discrete portions thereof and then developing said portions in response to application of toner material, means for developing said portions comprising a supply reservoir of liquid toner material, a first elongate tray extending across the path of said web and lying adjacent same, a second elongate tray containing said first tray and acting as a catch basin for recovering toner overflowing from said first tray, a pump and connections for recirculating liquid toner material along a path defined from said reservoir to said first tray then overflowing said toner material from said first tray into said second tray and returning said toner to said reservoir, said first tray being disposed at a level serving to carry the overflowing toner material into wetting contact with said web portions to develop same, and recovery means downstream of said first tray for removing toner from said web comprising an elongate, hollow, open top channel member formed to include upwardly extending side walls defining the upstream and downstream side walls of said channel member, the upper end edges of said side walls providing a relatively sharp scraping edge disposed to extend across the path of said web for engaging the undersurface of said web, the edge of the upstream side wall serving to physically remove the main portion of the unadhered liquid toner from the web, the edge of the downstream side wall of said channel member serving to physically remove substantially all the remaining toner carried by said web, said channel member including a drain opening therein for withdrawing toner material removed from said web, and vacuum means coupled to said drain opening for recovery of toner from said channel member, said vacuum means including fluid connections between said pump and said drain for applying a suction to said channel member in response to operation of said pump.

2. In a printing machine of a type having an elongate web of material to be moved in a predetermined path for printing thereon by charging discrete portions thereof and then developing said portions in response to application of toner material, means for developing said portions comprising a supply reservoir of liquid toner material, a first elongate tray extending across the path of said web and lying adjacent same, a second elongate tray containing said first tray and acting as a catch basin for recovering toner overflowing from said first tray, a pump and connections for recirculating toner material along a path defined from said reservoir to said first tray then overflowing said toner material from said first tray into said second tray and returning said toner to said reservoir, said first tray being disposed at a level serving to carry the overflowing toner material into wetting contact with said web portions to develop same, and recovery means downstream of said first tray for removing toner from said web comprising an elongate, hollow, open top channel member formed to include upwardly extending side walls, the upper end edges of said side walls being disposed to extend across the path of said web for engaging the undersurface of said web, said channel member including a drain opening therein for withdrawing toner material removed from said web, means forming a fluid path defined between said drain opening and said reservoir to return the withdrawn toner material to said reservoir, said recovery means including vacuum means forming a suction coupled to said drain via the fluid path of the last named said means to said channel member, said suction serving to draw said web into engagement with the upper end edges of said channel member to define a vacuum cavity whereby said vacuum serves to remove toner material from said cavity for return to said reservoir, said vacuum means including means forming a hydraulic head of toner in fluid communication with said drain opening, the height of said hydraulic head serving to establish the degree of suction in said channel member.

3. In an electrostatic printing machine of a type having means for applying fluid toner material to a surface of a web of print material, a vacuum channel member extending transversely of the path of movement of said web for removing toner from said surface, said channel member being formed with an upwardly directed open cavity surrounded by walls which terminate at their upper end edges in substantially a common plane for supporting said web thereacross to substantially seal said cavity, a flow passage formed to lead fluid toner out of said cavity, vacuum means coupled in fluid communication to said flow passage for withdrawing toner material from said cavity via said flow passage, and means serving to form a hydraulic head of toner in fluid communication with said flow passage to permit the height of said hydraulic head to establish the degree of vacuum applied to said flow passage.

4. In an electrostatic printing machine of a type having means for applying fluid toner material to a surface of a web of print material, a vacuum channel member extending transversely of the path of movement of said web for removing toner from said surface, said channel member being formed with an upwardly directed open cavity, means for carrying said web across said cavity to substantially seal said cavity, a flow passage formed to lead fluid toner out of said cavity, vacuum means coupled in fluid communication to said flow passage for withdrawing toner material from said cavity via said flow passage, means serving to form a hydraulic head of toner in fluid communication with said flow passage to permit the height of said hydraulic head to establish the degree of vacuum applied to said flow passage, and a valve coupled to the last named said means and operable between open and closed positions for respectively releasing or retaining said head of toner, and means responsive to arrested movement of said web serving to operate said valve to its closed position to retain said head of toner while said web is at rest.

5. In an electrostatic printing machine hydraulic means for forming a fluid toner fountain for applying said toner to a surface of a web of print material disposed across said fountain, a reservoir of fluid toner and connections forming a fluid path for passing said toner to said fountain from said reservoir, a suction member extending transversely of the path of said web for removing toner from said surface, said suction member being formed with an upwardly directed open cavity surrounded by walls which terminate at their upper end edges in substantially a common plane for supporting said web across said cavity in substantially sealed relation thereto, a flow passage formed to lead fluid toner out of said cavity, liquid pumping means serving to pump toner from said reservoir to said fountain via the first named said fluid path and serving to form a hydraulic pressure column of toner and means serving to couple the low pressure portion of said hydraulic pressure column to said cavity for sucking said web into sealing relation with the upper end edges of said walls while withdrawing toner from the cavity.

6. In an electrostatic printing machine according to claim 5 wherein said pumping means comprises a pair of pumps one being disposed in and serving to form said hydraulic column, the other of said pumps being disposed to pump toner from said reservoir to said fountain.

7. In an electrostatic printing machine according to claim 6 wherein said pumping means comprises a single pump disposed to pump toner from said reservoir to form said hydraulic pressure column and then to discharge toner from said column into said fountain to supply toner thereto.

8. In an electrostatic printing machine of a type having an elongate web of print material to move in a predetermined path to be printed upon by application of toner material thereto, a toner fountain system comprising an elongate open tray extending transversely of said path in confronting relation to said web, a reservoir of fluid toner material, means forming a first hydraulic column for passing toner from said reservoir to said fountain, a suction member disposed downstream of said fountain for applying suction to said web and for removing toner, means forming a second hydraulic column coupled in fluid communication to said suction member for determining the degree of suction therein, and pump means serving to pass toner from said reservoir to said fountain and for forming said second column.

9. In an electrostatic printing machine according to claim 8 in which said pump means comprises a single pump common to both said columns.

10. In an electrostatic printing machine according to claim 8 in which said pump means comprises individual pumps, one in each of said columns, said columns being independent of each other.

11. In an electrostatic printing machine according to claim 8 further comprising a valve in said second column operable between open and closed positions, and means responsive to arrested movement of said web serving to operate said valve to its closed position to retain liquid in said second column while said web is at rest.

12. In an electrostatic printing machine hydraulic means for forming a fluid toner fountain for applying said toner to a surface of a web of print material disposed across said fountain, a reservoir of fluid toner and connections forming a fluid path for passing said toner to said fountain from said reservoir, a suction member extending transversely of the path of said web for removing toner from said surface, said suction member being formed with an upwardly directed open cavity surrounded by walls which terminate at their upper end edges in substantially a common plane for supporting said web across said cavity in substantially sealed relation thereto, a flow passage formed to lead fluid toner out of said cavity to said fluid path, liquid pumping means serving to pump liquid toner from said reservoir to said fountain via the first named said fluid path while withdrawing toner from said cavity via said flow passage and applying a suction to said cavity for sucking said web into sealing relation with the upper end edges of said walls.

13. In an electrostatic printing machine of a type having an elongate web of print material to move in a predetermined path to be printed upon by application of toner material thereto, a toner fountain system comprising an elongate open tray extending transversely of said path in confronting relation to said web, a reservoir of fluid toner material, means forming a first hydraulic column for passing toner from said reservoir to said fountain, pump means serving to pass toner from said reservoir to said fountain via said first column, a suction member disposed downstream of said fountain for applying suction to said web and for removing toner, means forming a fluid connection between said suction member and said column for providing a suction in said suction member in response to the flow of toner between said pump and said fountain.

* * * * *